US008143592B2

(12) United States Patent
Tartaglia

(10) Patent No.: US 8,143,592 B2
(45) **Date of Patent: *Mar. 27, 2012**

(54) FILLING SYSTEM FOR POTENTIALLY HAZARDOUS MATERIALS

(75) Inventor: Daniel Tartaglia, St. Leonard (CA)

(73) Assignee: DRAXIMAGE General Partnership (CA)

( * ) Notice: Subject to any disclaimer, the term of this patent is extended or adjusted under 35 U.S.C. 154(b) by 145 days.

This patent is subject to a terminal disclaimer.

(21) Appl. No.: 12/769,955

(22) Filed: Apr. 29, 2010

(65) Prior Publication Data

US 2010/0206425 A1 Aug. 19, 2010

Related U.S. Application Data

(63) Continuation of application No. 11/553,625, filed on Oct. 27, 2006, now Pat. No. 7,750,328.

(51) Int. Cl.
*B65B 3/04* (2006.01)
*G21F 5/00* (2006.01)

(52) U.S. Cl. ..... 250/430; 250/428; 250/507.1; 141/2; 141/18; 141/27; 166/260; 166/305.1; 376/262; 376/268

(58) Field of Classification Search ..... 250/260, 250/505.1, 506.1, 506.7, 507.1, 515.1; 166/75.11, 166/177, 260, 250.12, 305.1, 372, 380, 384, 166/386, 387; 376/260, 262, 264, 268, 272, 376/283, 298; 141/2, 9, 18, 21–27, 100, 141/104, 301, 302

See application file for complete search history.

(56) References Cited

U.S. PATENT DOCUMENTS

| | | | | |
|---|---|---|---|---|
| 2,571,302 | A | 10/1951 | Smith | |
| 2,990,354 | A | 6/1961 | Anderson et al. | |
| 3,253,423 | A | 5/1966 | Sonnabend | |
| 3,383,923 | A | 5/1968 | Conche et al. | |
| 3,436,926 | A | 4/1969 | Bogner et al. | |
| 3,442,091 | A | 5/1969 | Elsner et al. | |
| 3,545,226 | A | 12/1970 | Caren et al. | |
| 3,982,134 | A * | 9/1976 | Housholder et al. | 250/506.1 |
| 4,234,798 | A * | 11/1980 | Baatz et al. | 250/506.1 |
| 4,235,569 | A | 11/1980 | Wegner et al. | |
| 4,582,638 | A * | 4/1986 | Homer et al. | 588/16 |
| 4,665,758 | A | 5/1987 | Schaarschmidt | |
| 4,698,510 | A | 10/1987 | Handke et al. | |
| 4,712,618 | A | 12/1987 | Handke et al. | |
| 4,854,355 | A | 8/1989 | Chazot et al. | |
| 4,986,956 | A | 1/1991 | Garabedian | |
| 5,309,774 | A | 5/1994 | Conche | |
| 5,343,506 | A * | 8/1994 | Artnik et al. | 376/280 |
| 7,163,031 | B2 * | 1/2007 | Graves et al. | 141/9 |
| 7,750,328 | B2 | 7/2010 | Tartaglia et al. | |
| 2005/0278066 | A1 | 12/2005 | Graves et al. | |
| 2008/0142743 | A1 * | 6/2008 | Tartaglia | 250/515.1 |

FOREIGN PATENT DOCUMENTS

| | | |
|---|---|---|
| CA | 2462611 A1 | 4/2003 |
| GB | 957306 | 5/1964 |

* cited by examiner

*Primary Examiner* — Bernard E Souw
(74) *Attorney, Agent, or Firm* — Woodcock Washburn LLP

(57) ABSTRACT

Systems, devices, and methods for filling containers with radioactive materials are described. In certain embodiments, the systems comprise a shielding material that substantially defines a chamber and, preferably, substantially blocks radioactivity, a conduit extending through the shielding material into the chamber, and a securing unit that is disposed in the chamber proximal to the conduit and is adapted to receive a container through the conduit.

28 Claims, 7 Drawing Sheets

FILLING SYSTEM FOR POTENTIALLY HAZARDOUS MATERIALS

CROSS-REFERENCE TO RELATED APPLICATIONS

The present application is a continuation of and claims priority to U.S. application Ser. No. 11/553,625, filed Oct. 27, 2006 (now allowed), which is hereby incorporated by reference in its entirety.

FIELD

The present invention relates to systems, devices, and methods for filling capsules and other types of containers with radioactive and/or other types of potentially hazardous materials.

BACKGROUND

A number of scientific uses require relatively small aliquots of radioactive materials. For example, nuclear medicine employs solutions of radioisotopes, such as Technetium-99m, Iodine-123, Iodine-125, Iodine-131, Phosphorous-32, Indium-111, Cobalt-57, and Chromium-51, as radiopharmaceuticals or as radioactive tracers. These radioisotopes typically are measured and dispensed for use. However, for safety reasons, it is highly desirable that the technician responsible for measuring and dispensing radioisotopes be exposed to minimal radioactivity. It is also desirable in some instances that the actual radioisotope doses be empirically determined in terms of radioactivity.

Thus, techniques for dispensing small volumes of radioactive materials are needed.

SUMMARY

In one aspect, the present invention provides systems for filling containers with radioactive and/or other types of potentially hazardous materials. Preferred systems are those that deposit one or more radioactive materials in relatively small containers such as capsules or small vials. Such systems typically comprise a shielding material that substantially defines a chamber and, preferably, substantially blocks radioactivity, a conduit extending through the shielding material into the chamber, and a securing unit that is disposed in the chamber proximal to the conduit and is adapted to receive a container through the conduit. The systems of the present invention can further comprise filling devices, at least one solution delivery device that is disposed in the chamber and adapted to meter an aliquot from a radioactive stock solution and inject the aliquot into the container; at least one of a logic device that controls the solution delivery device, and/or a tapered guide lid that is positioned over the radioactive stock solution.

The present invention also provides filling methods that involve, for example, using the conduit to place a first container in the securing unit, metering an aliquot from a radioactive stock solution, and injecting the aliquot into the container.

BRIEF DESCRIPTION OF THE DRAWINGS

The numerous objects and advantages of the present invention may be better understood by those skilled in the art by reference to the accompanying non-scale figures, which are provided by way of example and are not intended to limit the invention.

DETAILED DESCRIPTION

Figure 1:
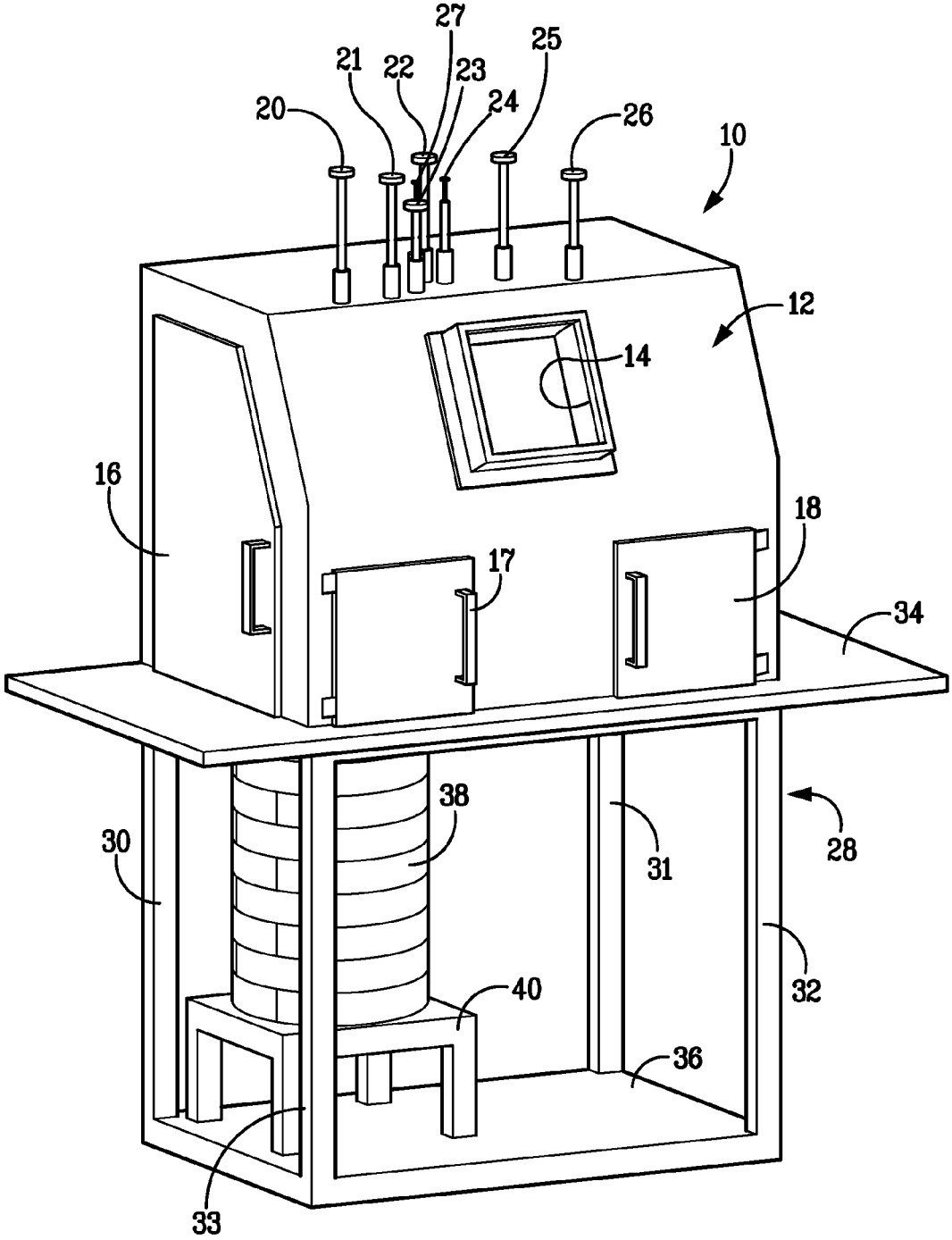
FIG. 1 is a perspective view of a container filling device.

The present invention provides systems for filling containers with radioactive and/or other types of potentially hazardous materials. Potentially hazardous materials according to the invention are those that present or are suspected to present one or more types of health risks to a human who is exposed to the material. Representative materials according to the invention include chemicals and biological agents including but not limited to poisons, toxins, mutagens, and teratogens. Materials of particular interest with respect to the present invention are those that emit one or more radioactive species.

Containers according to the invention are vessels that can contain or substantially contain a potentially hazardous material of interest. Vessels that contain the material include sufficient structure to surround it; vessels that substantially contain the material bound it with sufficient structure to restrict its movement in one or more directions. Containers of particular interest with respect to the present invention are those (such as capsules, tubes, ampoules, and vials) that are relatively small (i.e., have a volume less than about 10 mL, more preferably less than about 1 mL.

The systems of the invention include a shielding material that substantially defines a chamber. Any of a wide variety of shield materials can be used that provide an effective barrier to the potentially hazardous material and are either capable of forming a substantially closed surface shape that substantially defines a chamber or being disposed upon a substantially closed-surface shape that substantially defines chamber. Thus, a shielding material that substantially defines a chamber need not do so alone. Representative shielding materials include metals, alloys, and/or polymers; shield materials of particular interest are those (such as lead, tungsten, and other suitable metals and alloys) that provide an effective barrier to radioactive species. Preferably, the shielding material is at least as effective as lead. Chambers according to the invention can have virtually any shape, although substantially rectangular chambers and substantially cylindrical chambers are probably most common.

The systems of the invention include a conduit extending through the shield material into the chamber. Conduits according to the invention are substantially hollow structures that supply a pathway for introducing containers to the chamber. The conduit may be made from any suitable material such as, for example, lead, tungsten, and other metals and allows that provide an effective barrier to radioactive species. In cross-section, the conduit may have any shape, provided that the shape allows the container to pass through the conduit. Preferably, the shape of the conduit substantially corresponds to the shape of the container. In certain embodiments of the invention, conduits can be interchangeable such that each is adapted for use with specific containers. Conduits according to the invention can optionally include a device or other structure that permits manipulation objects within the chamber. One such representative device is a tamping rod that engages and helps seal the container.

The systems of the invention also include a securing unit that is disposed in the chamber proximal to the conduit and is adapted to receive a container through the conduit. Securing units according to the invention generally are capable of receiving at least one container and, preferably, more than one container. The portion of the securing unit that receives the container preferably has a shape that corresponds to the shape of the container. In embodiments in which the securing unit receives more than one container, the securing unit can be capable of being indexed, that is, of moving each container sequentially past a given work area. Indexing is useful for allowing the securing unit to receive further containers, to allow the containers to be filled, and/or to move the containers to an area where they may be removed from the securing unit. Preferably, the securing unit is a carousel, but all shapes that allow indexing, for example, a rectangle with an array of ports, are contemplated.

FIG. 1 shows one representative filling system 10 according to the invention having a shield material 12 and a window 14 disposed therein for viewing the chamber. The window 14 may be formed from any substantially transparent, radiation-shielding material, such as leaded glass, in any of the many known configurations. For example, the window 14 may a single layer of leaded glass or a plurality of layers having an inert gas or a shielding oil disposed between them.

The system shown in FIG. 1 also includes a plurality of doors 16-18 for accessing the chamber. These doors may be constructed of any suitable shielding material, and may comprise handles, hinges, locks, or other features typically found on doors. It is understood that the number of doors and windows may be varied within the spirit of the invention.

A plurality of rods 20-26 extend through shield 12 and into the chamber that it defines. At least one of the rods 20-26 is hollow, and thus can serve as a conduit through which a container can pass into the chamber. A removable tamper 27 can be disposed in the conduit to minimize or prevent radiation leakage and provide a structure that can be used to move or otherwise contact a container that has been placed in the chamber. In embodiments in which capsules are placed in the chamber, the rod can be used to tamp a cap upon the capsule. At least one of the rods 20-26 is rotatable to provide movement of components disposed inside the chamber, as will be described with regard to FIG. 2.

The system 10 is optionally placed on a table 28 or some other type of support. Table 28 has a plurality of legs 30-33, a top 34, and a base 36. Although not depicted, table 28 may further comprise at least two wheels to provide mobility, preferably four wheels.

In the particular embodiment shown in FIG. 1, an optional dose calibrator 38 having a stand 40 is associated with system 10. The dose calibrator 38 is provided with the necessary logic and components to measure the radioactivity of the dispensed materials to confirm dosage. Dose calibrators are commercially available from Capintec Inc., Ramsey, N.J., USA.

Figure 2:
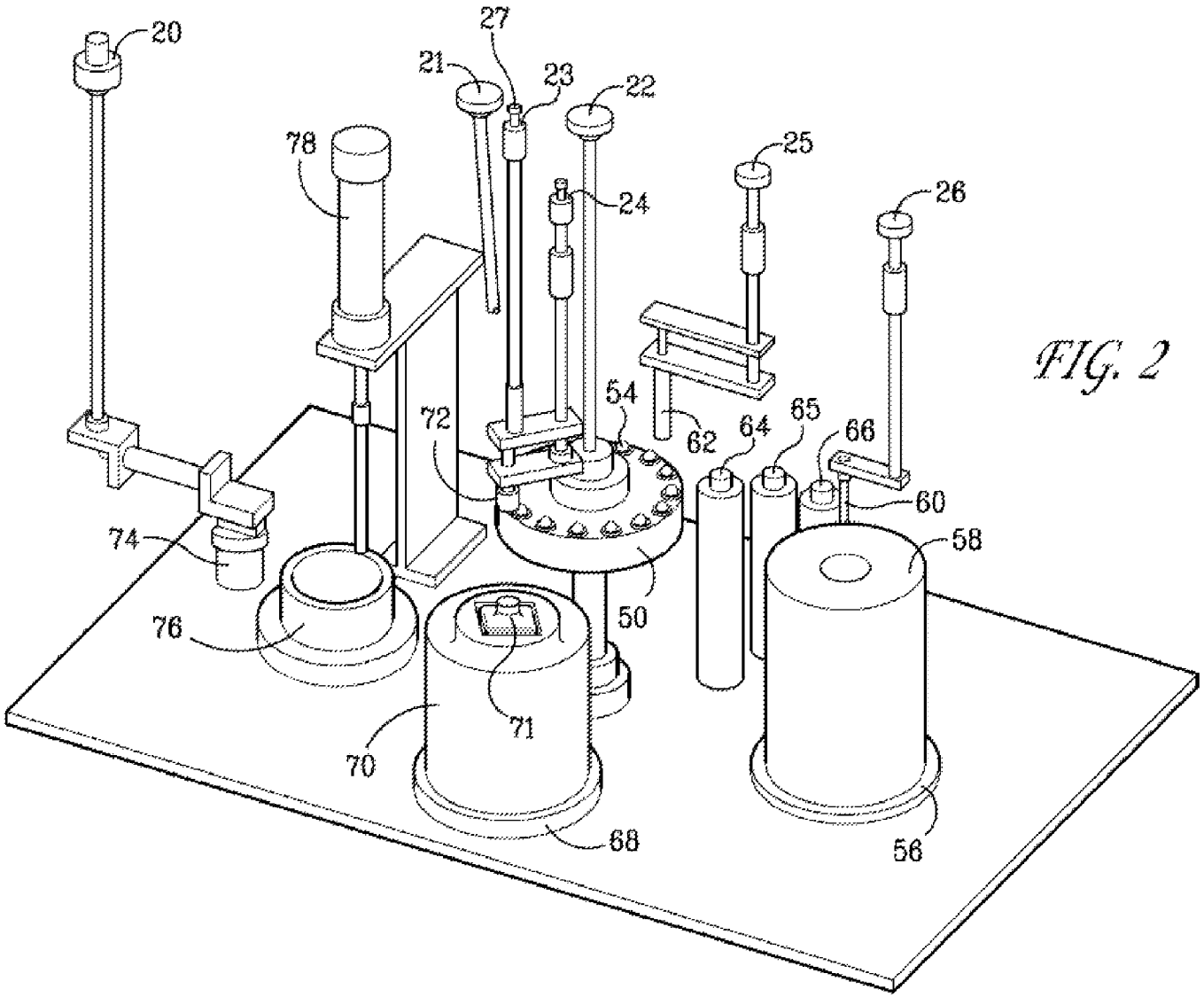
FIG. 2 is another perspective view of the filling device with the shield removed.
Figure 3:
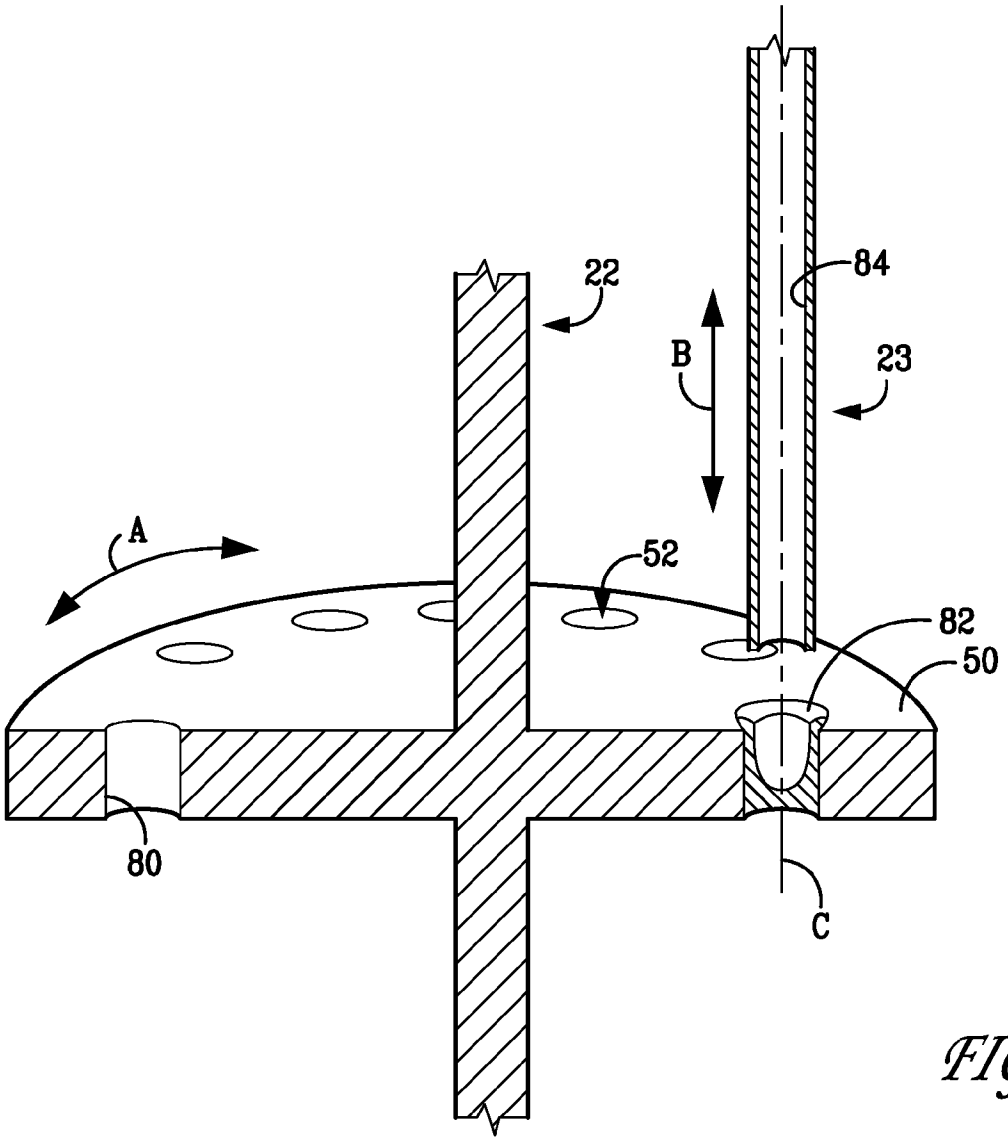
FIG. 3 is a sectional view of a securing unit and a conduit assembly within the device.

Turning now to FIGS. 2 and 3, the chamber contains a securing unit 50 having a plurality of ports 52 to receive a plurality of containers 54. Although the securing unit 50 is depicted as a carousel, those skilled in the art will appreciate that other designs are contemplated.

In the embodiment depicted, the container 54 is a capsule, although all type of containers can be used. Suitable capsules are well known to those skilled in radiopharmaceutical preparations, and include those commercially available from Capsugel, Greenwood, S.C., USA. In this embodiment, containers 54 are introduced to the ports 52 via a conduit formed in the rod 23, as will be described with reference to FIG. 3. It is understood that the conduit has a sufficient diameter to allow the container to pass. In certain embodiments of the invention, the conduit is treated (as, for example, with a lubricant) to reduce friction.

A locator 56 is provided in the chamber for placement of a stock solution container 58 of radioactive materials to be dispensed. The stock solution container 58 preferably is made of lead or tungsten. As will be further described with respect to FIG. 4, a guide 60 is attached to the rod 26 and disposed proximal to the locator 56.

A solution delivery device 62 rotates around an axis substantially defined by rod 25 and is movable between a position proximal to the securing unit 50 and a position proximal to the stock solution container 58. The solution delivery device 62 is used to fill container 54 with stock solution. As depicted, the solution delivery device 62 is a syringe. Suitable syringes and other types of devices for filling containers are well known to those skilled in radiopharmaceutical preparations, and include those commercially available from Becton Dickson, Franklin Lakes, N.J. USA or Qosina, Edgewood, N.Y., USA. A relatively long 22G needle is suitable for piercing a capsule such as described above. An optional guide (see structure 108 in FIG. 5) can be used to guide the needle of the solution delivery device 62 to container 54.

The solution delivery device 62 is associated with dispensing controls to allow accurate dispensing of the radioactive materials in selected volumes. Although doses may be determined in terms of radioactivity, it is helpful to accurately dispense certain volumes of stock solution to attain the desired radioactivity. In one embodiment, the volume of a dispensed aliquot of stock solution is about 1 μL to about 10,000 μL. Preferably, the volume of the aliquot is about 1 μL to about 500 μL, more preferably about 2 μL to about 200 μL. In one embodiment, the volume of the aliquot is less than about 1000 μL. Those skilled in the art will understand that term "filling" as used herein includes placing any volume of solution in a container, and does not require placing therein a volume that that corresponds to the container's capacity.

Metering of the aliquot can be effected through operation of a computer control means. Control means amenable to the practice of this invention include computing devices such as microprocessors, microcontrollers, capacitors, switches, circuits, logic gates, or equivalent logic devices. In one embodiment, the controls provide a plurality of volumes from which to select. Alternatively, the controls can provide for data entry to specify the volume desired. The controls may also be used to achieve a certain dosage. For example, if the concentration of stock solution is provided, the controls may calculate the volume required to attain a certain radioactive dose. Moreover, if a dosage of a certain radioactivity will be required for administration later, for example, two days later, the controls can account for the radioactive decay rate by dispensing an aliquot which has a radioactivity greater than the desired dosage by an amount representing the decay factors occurring over the time between dispensing and administration. Those skilled in the art will readily appreciate these and other desirable features of the controls based on the foregoing, as well as how to obtain them, such as by programming.

For use in dispensing radiopharmaceuticals or other types of potentially hazardous material, the solution delivery device 62 may require rinsing or sterilizing. A plurality of optional holding containers 64-66 are provided for receiving the needle of the solution delivery device. These holding containers 64-66 may contain conventional rinse or sterilization solutions. In certain embodiments, the rinse solution is water or isopropyl alcohol.

A second locator 68 is provided in the chamber for indicating placement of a shipping container 70 for receiving a shipping vial 71. The shipping container 70 preferably is made of lead, tungsten, alloys, or any material with a density greater than or equal to lead, provided it substantially blocks radioactivity. The shipping vial 71 is necessarily smaller than the shipping container and is the vessel in which the container (s) are actually placed. The shipping vial preferably is plastic. The shipping container 70 and the shipping vial 71 have substantially similar shapes at their interface. The shapes cooperate to prevent the shipping vial 71 from rotating when capped or uncapped. In one embodiment, the distal end of the rod 21 (not depicted) is adapted to grasp the cap of the shipping vial. This rod 21 assembly can also lift the shipping vial 71 for visual inspection.

A container transfer assembly 72 is attached to the rod 24 and includes a receiver (118, FIG. 6) that is adapted to engage a container and remove it from the securing unit 50. The transfer assembly 72 then places the container 54 in the shipping vial 71. In one embodiment, the transfer assembly 72 operates by creating a snug fit between receiver (118, FIG. 6) and container 54. The container may be released applying a force to the container sufficient to overcome the snug fit, as will be discussed with reference to FIG. 6.

A vial transfer assembly 74 is attached to the rod 20 and includes a receiver that is adapted to engage the shipping vial 71 and remove it from the shipping container 70. The vial transfer assembly 74 then places the shipping vial 71 in the dose calibrator 38 (FIG. 1) via an access port 76. The access port 76 can be brought closer to the dose calibrator by an optional actuator 78 such as a pneumatic cylinder with associated controls. The vial transfer assembly 74 can be used to recapture the shipping vial 71 after the dose calibrator 38 (FIG. 1) determines the dosage and to place the shipping vial back in the shipping container 70.

The capped shipping vial may receive an aluminum seal to indicate it has been secured. In certain embodiments, the aluminum seal is crimped on the capped shipping vial. The capped shipping vial may alternatively receive a screw cap or a snap cap to indicate it has been secured.

Referring to FIG. 3, the securing unit 50 is rotatable around the axis substantially defined by rod 22, as depicted by double headed arrow A, to allow the various ports 52 to come proximal to rod 23. Each port 52 may comprise a bore 80 and a port insert 82 disposed within the bore. A variety of shapes are contemplated for the port inserts 82, provided that the shapes have complementary surfaces to accommodate the desired container. In operation, a container, such as a capsule, is passed down the conduit 84 of the rod 23 along an axis C and received in the port 52 proximal to the distal end of the rod. The securing unit 50 is then indexed in either direction indicated by arrow A, to bring an empty port 52 proximal to rod 23 to receive another container. Alternatively, the securing unit could remain stationary and the rod 23 could be provided to move around the securing unit to allow indexing.

In certain embodiments, the rod 23 is lowered to the securing unit 50, as depicted by double headed arrow B, to dispose the container in the port 52. This allows the container to be properly aligned. Thus, in embodiments where the rod 23 can be lowered to the securing unit 50, the securing unit and the conduit are adapted to move with respect to each other in a first plane and a second plane.

A rod that is adapted to pass through the conduit 84 and engage the container may be provided. This rod may be used to tamp a cap on a filled capsule, for example.

Figure 4:
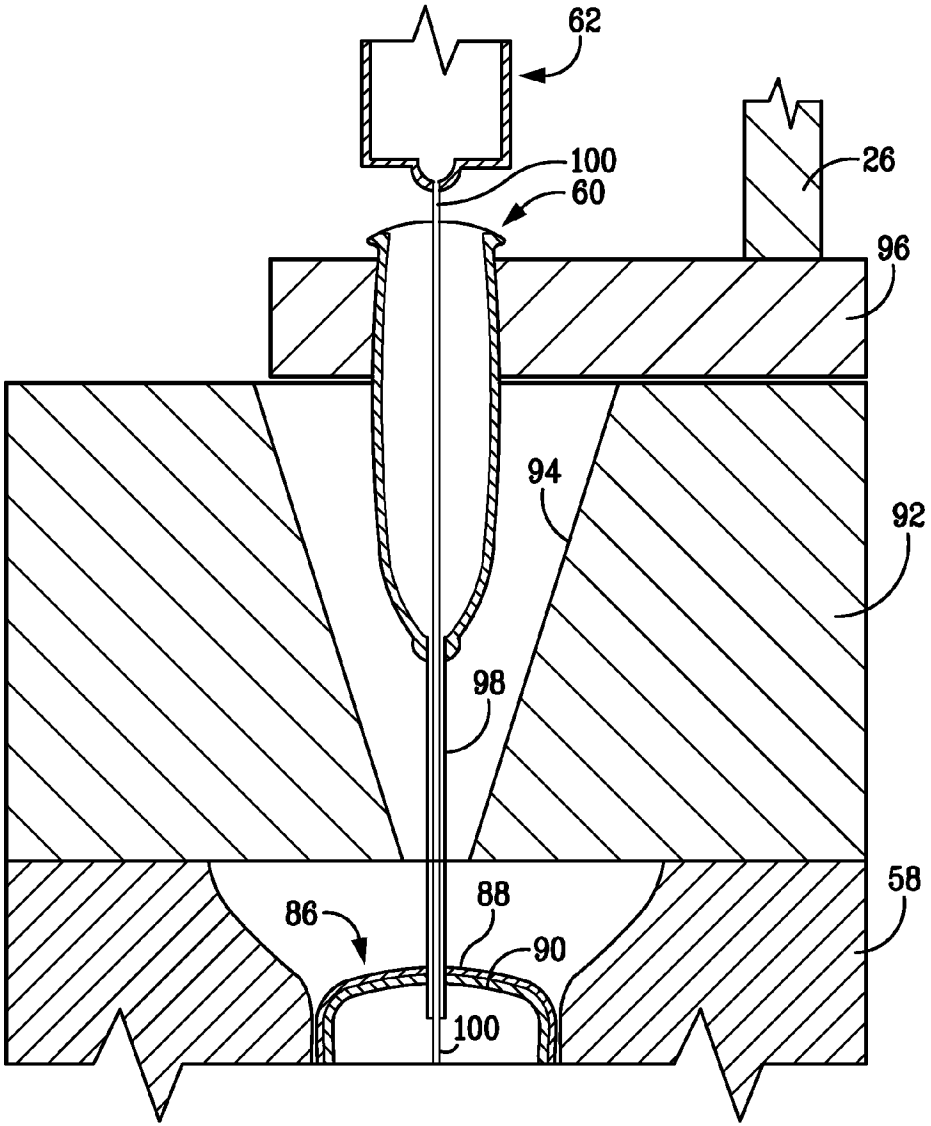
FIG. 4 is a sectional view of a stock solution container and a needle assembly.

Turning now to FIG. 4, the stock solution container 58 surrounds a vial 86 of a stock solution such as, for example, Technetium-99m, Iodine-125, Iodine-131, Phosphorous-32, Indium-111, Cobalt-57, and/or Chromium-51. Stock solution vials conventionally are capped with an aluminum layer 88 and a rubber septum 90.

A guide lid 92 according to certain embodiments of the present invention is adapted to be placed on the stock solution container 58 to guide the solution delivery device 62 to the stock solution vial 86. The guide lid 92 may be formed from, for example, lead or tungsten, and has a generally tapered inner wall 94 that can direct objects placed therein to the central portion of the area that the wall defines. Those skilled in the art will recognize that this inner wall need not have the continuously sloping surface depicted in FIG. 4, but simply should taper to the extent necessary to direct objects placed therein to its central portion.

In certain embodiments, the guide 60, attached to the rod 26 via a plate 96, is also provided to guide the solution delivery device 62 to the stock solution vial 86. The guide 60 can include a relatively thick 16G needle 98 suitable for piercing the aluminum layer 88 and the rubber septum 90 of the stock solution vial. The gauge of the needle 98 should generally be sufficiently large to allow a needle 100 of the solution delivery device 62 to pass through it, thus allowing the needle 100 to reach the stock solution to draw an aliquot as described above.

Figure 5:
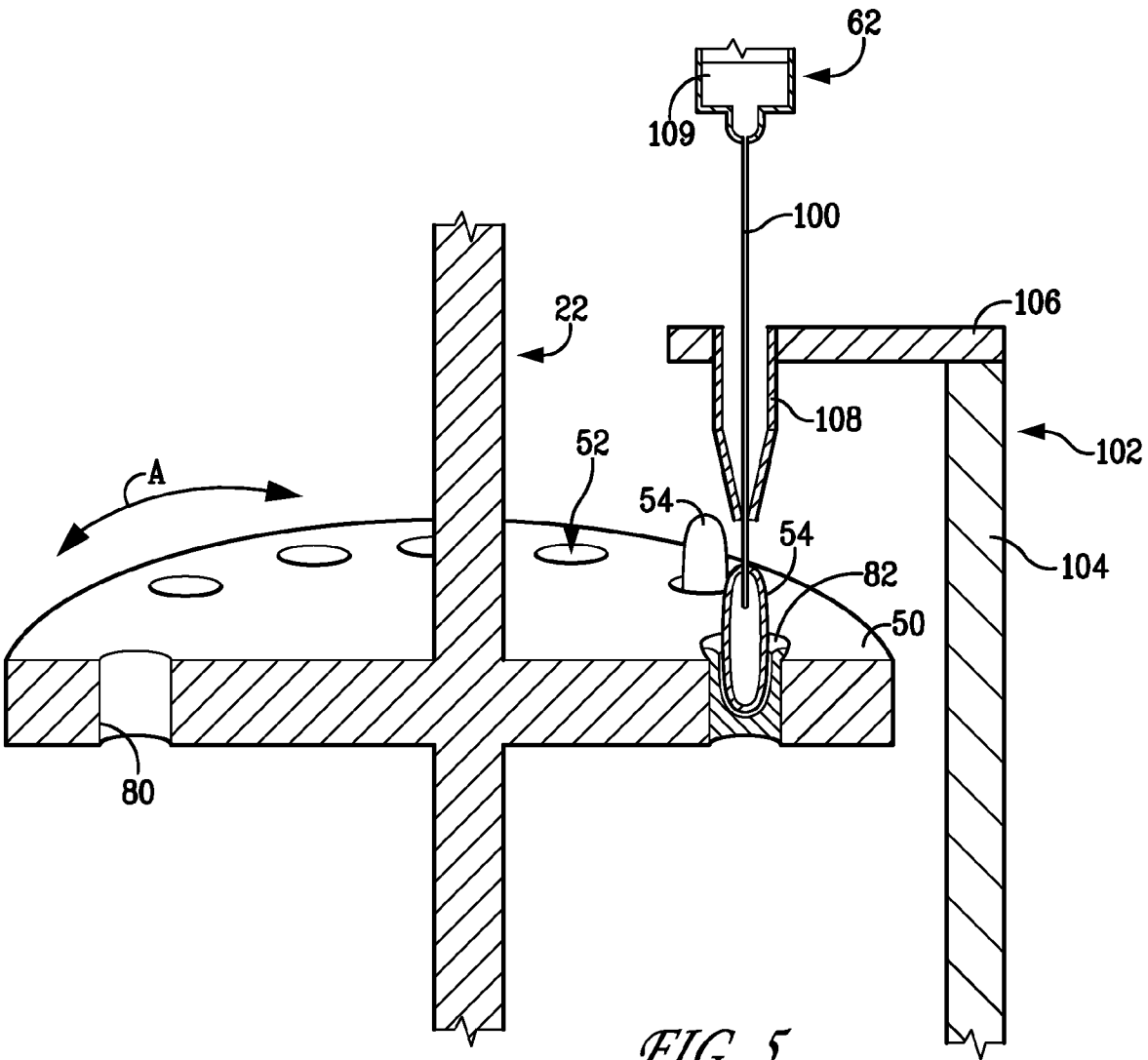
FIG. 5 is a sectional view of a securing unit and a needle assembly.

Referring to FIG. 5, a filling guide 102 is provided comprising a rod 104, a plate 106 attached to the rod 104, and a tapered guide member 108 attached to the plate. The solution delivery device 62 typically retains an amount of stock solution 109. The generally tapered guide member 108 reinforces the needle 100 of the solution delivery device 62 to facilitate piercing of the container 54 to deliver the aliquot and directs the needle to the central portion of the guide member. In certain embodiments, the plate 106 acts as a stop to prevent the needle 100 from protruding too far into container 54.

Figure 6:
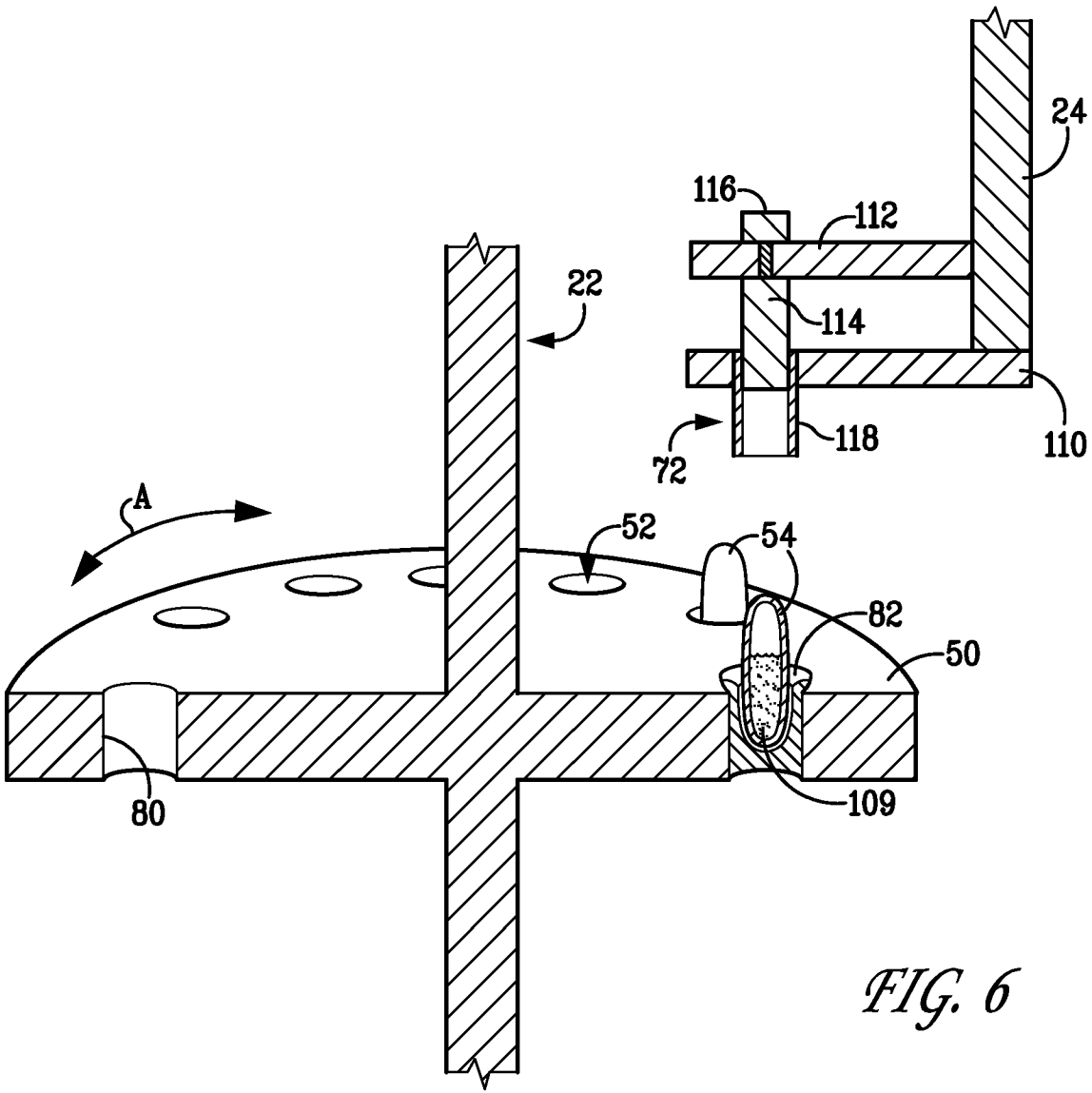
FIG. 6 is a sectional view of a securing unit and a container transfer assembly.

Turning to FIG. 6, container transfer assembly 72 is shown having a first plate 110 and a second plate 112 attached to the rod 24. A pin 114 is disposed between the plates 110 and 112, and is actuated by an actuator 116. The pin 114 is optional, as the transfer assembly 72 could be tapped against the shipping vial to remove the container or a pneumatic force could be used in place of the pin and actuator.

A flexible plastic apron 118 is disposed in the transfer assembly 72 to engage a container in a snug fit. The fit should be sufficient tight to allow the container to be lifted from the port 52, but not so tight as to damage the container upon application of a force required to release it from the apron 118. The transfer assembly 72 engages the container, removing it from the securing unit 50, and can be used to place the container in a shipping vial 71.

In operation, a container is placed in the securing unit via the conduit and an aliquot from a radioactive stock solution is metered out and injected into the container. The securing unit may be indexed and another container injected with an aliquot from a radioactive stock solution. The radioactive stock solutions can be the same or different, and the volumes of the aliquots can be the same or different.

Figure 7:
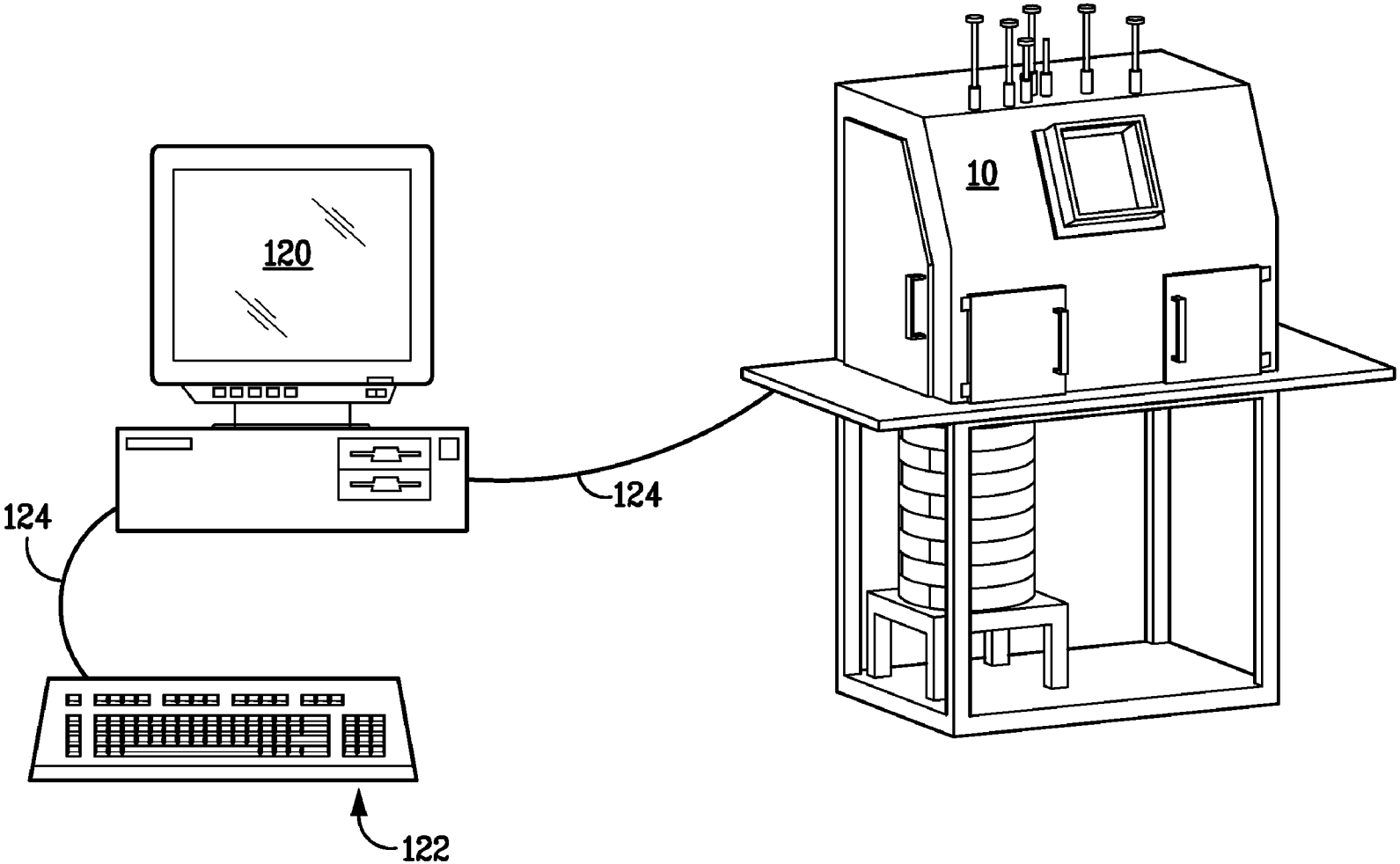
FIG. 7 is a schematic of system including a container filling device.

Referring to FIG. 7, a system is depicted comprising a filling system 10, a logic device 120, a data entry device 122, and traces 124 for electrically connecting the components are provided. The filling system 10 is described above. The logic device 120 may be the same or different as the control means described above, and includes computing devices such as microprocessors, microcontrollers, capacitors, switches, circuits, logic gates, or equivalent logic devices. The data entry device 122 may be a keyboard, a notepad, a dial, or a series of setting switches.

Certain features are, for clarity, described herein in the context of separate embodiments, but may also be provided in combination in a single embodiment. Conversely, various features that are, for brevity, described in the context of a single embodiment, may also be provided separately or in any subcombination. Further, reference to values stated in ranges include each and every value within that range.

After reading the concepts that have been described with reference to specific embodiments, skilled artisans will appreciate that other aspects, modifications, changes, and embodiments are possible without departing from the scope of the invention as set forth in the claims below. Accordingly, the specification and figures are to be regarded in an illustrative rather than a restrictive sense, and all such modifications are intended to be included within the scope of invention.

Many aspects and embodiments have been described above and are merely exemplary and not limiting. Benefits, advantages, solutions to problems, and any feature that may cause the same to occur are not to be construed as a critical, required, or essential feature of any or all the claims.

What is claimed:

1. A container filling system, comprising:

a shielding material that substantially blocks radioactivity and substantially defines a chamber;

a conduit extending through the shielding material into the chamber;

a container securing unit that is disposed in the chamber proximal to the conduit and is adapted to receive a container via the conduit; and a solution delivery device that is disposed in the chamber and is adapted to meter an aliquot from a radioactive stock solution and inject the aliquot from said stock solution into the container.

2. The system of claim 1, wherein the container securing unit includes a port adapted to receive the container.

3. The system of claim 1, wherein the container securing unit includes multiple ports that are each adapted to receive a container.

4. The system of claim 1, wherein the ports include an insert.

5. The system of claim 1, wherein at least one of the container securing unit and the conduit are adapted to move with respect to each other in a first plane.

6. The system of claim 1, wherein the container securing unit and the conduit are adapted to move with respect to each other in a first plane and a second plane.

7. The system of claim 1, further comprising a locator that is disposed in the chamber and is adapted to direct placement of a container.

8. The system of claim 1, further comprising a pair of locators that are each disposed in the chamber and adapted to direct placement of a shipping container and a radioactive stock solution vessel.

9. The system of claim 1, further comprising a dispensing arm that is disposed in the chamber and adapted to receive a solution delivery device.

10. The system of claim 1, further comprising a guide that is disposed in the chamber and adapted to engage a radioactive stock solution container.

11. The system of claim 1, further comprising a receiver that is disposed in the chamber and adapted to engage a cap of a container shipping vial.

12. The system of claim 1, further comprising a tapered guide member that is disposed in the chamber proximal to the container securing unit and adapted to direct a container filling needle into a container.

13. The system of claim 1, further comprising a rod that is adapted to pass through the conduit and engage the container.

14. The system of claim 1 wherein the solution delivery device is movable via rotation about an axis between a position proximal to said container securing unit and a position proximal to a stock solution vessel.

15. The system of claim 1, further comprising a receiver that is adapted to engage a container and remove it from the container securing unit.

16. A method for filling one or more containers, comprising:

providing the system of claim 1;

placing a first container in the container securing unit via the conduit;

metering an aliquot from a radioactive stock solution; and injecting the aliquot into the container.

17. The method of claim 16, further comprising at least one of:

moving either the conduit or the container receiving unit in a first plane and placing a second container in the container securing unit;

indexing either the conduit or the container receiving unit and placing a second container in the container securing unit; and engaging the conduit and the container receiving unit and placing the container in the container securing unit.

18. The method of claim 16, further comprising disposing a needle proximate a radioactive stock solution container.

19. The method of claim 18, wherein at least one of a needle and a tapered guide lid is placed above the radioactive stock solution.

20. The method of claim 16, where metering of the aliquot is effected through operation of a computer control means.

21. The method of claim 16, wherein the aliquot has a volume of about 1 μL to about 10,000 μL.

22. The method of claim 16, further comprising:

placing at least one further container in the container securing unit via the conduit;

metering at least one further aliquot from a radioactive stock solution; and injecting at least one further aliquot into the at least one further container.

23. The method of claim 22, wherein the first container and at least one further container are injected with different radioactive solutions, or wherein the first container and at least one further container are injected with different doses of the same radioactive solution.

24. The method of claim 16, further comprising at least one of:

guiding a needle into a container;

placing a cap upon the container;

tamping a cap upon the container using a rod passing through the conduit;

engaging the container and removing it from the container securing unit;

uncapping a container shipping vial;

engaging the container and placing it in the container shipping vial;

capping the container shipping vial;

placing an aluminum seal on a capped container shipping vial; and crimping an aluminum seal on a capped container shipping vial.

25. The method of claim 16, further comprising determining the dose contained in a container shipping vial including at least one container having an aliquot.

26. The method of claim 25, wherein a dose calibrator is used to determine the dose contained in the container shipping vial.

27. A system comprising:

the system of claim 1; and at least one of:

a logic device that controls the solution delivery device; and a tapered guide lid that is positioned over the radioactive stock solution.

28. The system of claim 27, further comprising a shipping container that is adapted to receive a container shipping vial, wherein the shipping container and container shipping vial have substantially similar shapes at their interface.

* * * * *